United States Patent [19]

Parker et al.

[11] 4,074,762

[45] Feb. 21, 1978

[54] WIRELINE RUNNING TOOL

[75] Inventors: William H. Parker, Hurst, Tex.; Lawrence Hart, College Station, both of Tex.

[73] Assignee: Del Norte Technology, Inc., Euless, Tex.

[21] Appl. No.: 741,855

[22] Filed: Nov. 15, 1976

[51] Int. Cl.[2] ..... E21B 7/06; E21B 43/00

[52] U.S. Cl. ..... 166/315; 166/63; 166/117.5

[58] Field of Search ..... 166/117.5, 117.6, 63, 166/315

[56] References Cited

U.S. PATENT DOCUMENTS

| | | | |
|---|---|---|---|
| 1,747,398 | 2/1930 | Short | 175/93 |
| 3,138,207 | 6/1964 | Peppers | 166/120 |
| 3,837,398 | 9/1974 | Yonker | 166/117.5 |
| 3,876,001 | 4/1975 | Goode | 166/117.5 |
| 3,889,748 | 6/1975 | Tausch | 166/117.5 |

*Primary Examiner*—James A. Leppink

[57] ABSTRACT

A wireline running tool enables a module to be lowered into or removed from a production tubing or pipe line, especially one extending downhole in an oil or gas well. A kickover arm in the tool deflects the module into a side pocket in the tubing or pipe. The power for so deflecting such module comes from a pressurized pneumatic cylinder. If something goes wrong and the tool or module becomes stuck in the tubing or pipe, the gas slowly leaks from the pneumatic cylinder, after which the tool or module becomes unstuck.

19 Claims, 7 Drawing Figures

WIRELINE RUNNING TOOL

This invention relates to wire running tools, and more particularly to tools for guiding and directing objects into side pockets of production tubing or a pipe, especially one used downhole in oil or gas wells.

The term "oil well" is used herein in a generic sense to cover all suitable and similar structures, without regard to whether the well is drilled to produce oil, gas, water, or any other purpose. In addition, the term is intended to cover any communication through a tubing or pipe line, without regard to the purpose of the pipe line. For example, it is conceivable that the invention might be used in conjunction with submarine cable sheaths, pipe lines for transporting oil or gas over land, or the like. Thus, any references to an "oil well" are to be construed broadly enough to cover all suitable structures, and references to "raising" and "lowering" the tool are to be construed to cover all forms of movement, whether horizontal or not.

Gas and oil wells are drilled into the earth, to great depths. As the drill goes down, a casing is lowered into the well to preserve and maintain the integrity of the walls of the hole against crumbling, percolating water, or the like. After the well is completed, a production tubing or pipe line is lowered through the casing. Thereafter, the oil, gas, water, or the like, is pumped or otherwise transported through the production tubing or pipe, up to the surface of the earth.

For efficient operation, certain equipment must be placed in the tubing or pipe line at points which are remote from the accessible end. For example, it may be necessary or desirable to mount sensors or electronic control circuits at the bottom of the well. These sensors may automatically operate pumps or valves, also at the bottom.

This type of installation and operation raises a number of problems. The equipment placed in the tubing or pipe must not obstruct or otherwise interfere with the flow therethrough. Therefore, it is customary to place the equipment in a "side pocket" or "mandrel" which is hung outside the pipe. It is necessary to install, service, maintain, and remove the equipment from the accessible end of the pipe. Thus, it is necessary to provide some means for diverting the tool or module containing the equipment into or removing it from the side pocket on the tubing or pipe line at any time, regardless of the other utilizations of the tubing or pipe line.

The device which is used for lowering or raising the equipment is generally called a "wireline tool". It is adapted to grip the equipment while it is being lowered into the production tubing or pipe line. When the equipment is lowered far enough it passes adjacent the side pocket, and is diverted into the side pocket. Thereafter, the wireline tool releases its grip to enable the equipment to come to rest in the side pocket, after which it may be removed from the pipe, while the equipment remains in place in the side pocket. Later, the wireline tool may be lowered again into the well, where it diverts itself into the side pocket and once more grips the equipment. When the wireline tool is thereafter pulled from the production tubing or pipe line, it removes the equipment. The invention is primarily concerned with the diversion of equipment into and out of the side pocket, and with the releasing and gripping of the equipment.

Accordingly, an object of the invention is to provide new and improved wireline running tools. In particular, an object is to provide such wireline tools which are capable of lowering, lifting, and manipulating relatively large modules while they are deep in a well. Here, an object is to provide a source of energy within the wireline tool which helps to manipulate it when it is at or near the bottom of an oil well.

A further object is to provide a power source which slowly exhausts itself so that the wireline running tool may become unstuck if something goes wrong downhole and the tool deploys prematurely.

Still another object of the invention is to provide simple, and yet reliable, wireline tools. Here, an object is to provide new and novel ways of operating a diversion mechanism for deflecting a module on the end of a line into a side pocket on a pipe line.

Another object of the invention is to provide new and novel processes for, and methods of, manipulating equipment on the end of a line while it is deep in a production tubing or pipe line.

In keeping with an aspect of the invention, these and other objects are accomplished by a novel wireline running tool. Compressed gas is stored in a reservoir to function as a propulsion means for actuating a mechanism that forces the module out of the axis of the production tubing and into a new attitude, leading into a side pocket or a special mandrel hung outside the pipe.

It has been the practice to use a steel spring or springs to actuate a mechanism for changing the attitude of the module. However, the size and weight of a large module precludes the use of a conventional spring in the wireline tool for such a purpose. Therefore, the invention uses pressurized gas as a propulsion agent for generating a thrust of two to three thousand pounds along the axis of the wireline running tool. This immense thrust has great advantages since it may be used for moving heavy objects into the new attitudes.

The inventive tool uses a kickover piston which drives an arm into its extended position responsive to a thrust generated from the pneumatic mechanism. Further, this arm transmits tremendous forces through a linkage, in the desired direction, to divert and set a module in a side pocket. Yet, the extended arm has a relatively small reaction to an extraction of the wireline tool.

A void, called the "guide region", is produced in the mandrel so that the arm and module may freely slide vertically when the arm is extended. However, once the module has been delivered to the side pocket, the arm retracts into an axial alignment with the wireline tool so that the entire assembly may be pulled out of the production tubing. If the arm becomes extended at an improper time so that the module becomes stuck, the pneumatic pressure leaks off to release the arm.

The nature of a preferred embodiment for accomplishing these and other objects is seen in the attached drawings, wherein:

FIG. 1 schematically shows a downhole casing, production line tubing, side pocket mandrel, and a module being diverted into the side pocket;

Figure 1:
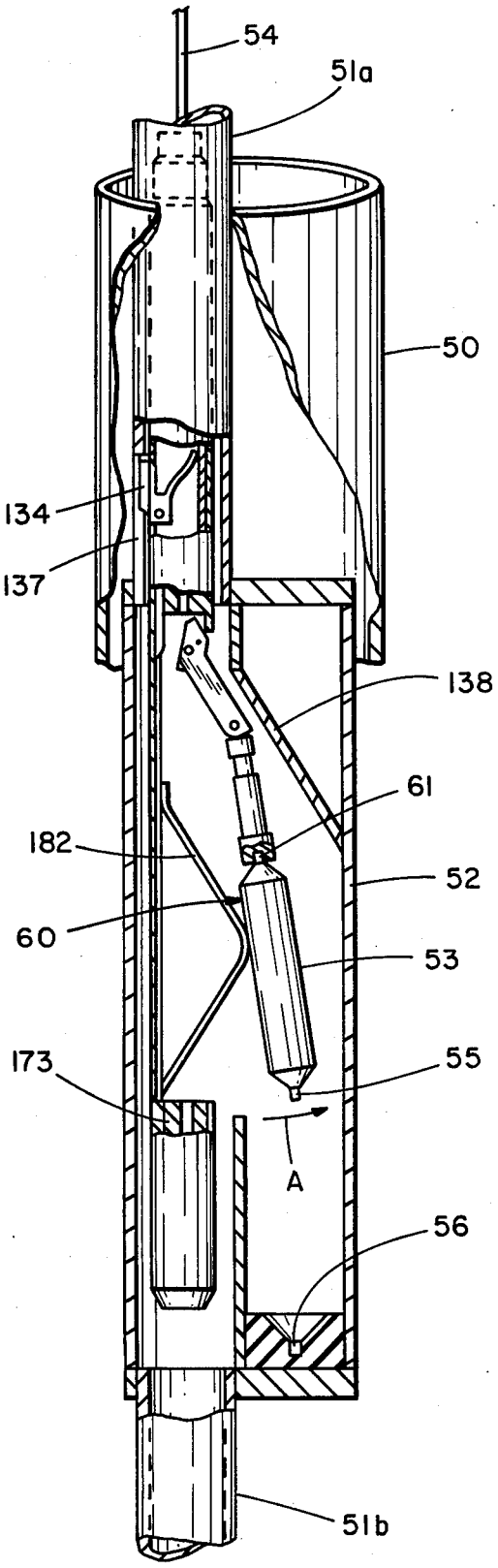

The nature and use of the invention may become broadly apparent from a study of FIG. 1, which shows a small segment of an oil well production tubing or pipe line with an associated side pocket mandrel. Briefly, a fairly large diameter outside the casing 50 is installed in an oil well, as it is drilled. This casing is primarily designed to preserve the drilled hole against crumbling walls, percolating water, and the like. Once the hole is drilled and lined with the casing 50, a production tubing or pipe line 51 may be lowered therein, or removed therefrom. The gas or oil is actually pumped from the well and up the pipe line 51 to the surface.

Equipment may be required at various depths, for any of many different reasons. For example, a sensor may be required at the bottom of the well in order to detect certain dangerous conditions and to close a disaster valve, responsive thereto. This valve action may prevent run-away conditions which could result in oil spills that would pollute the environment. Such equipment may require a battery pack which supplies energy to the sensor. Hence, the sensor represents equipment that should be serviced or replaced sporadically, as when it becomes defective or obsolete. The battery pack represents maintenance equipment which must be replaced periodically. These are but a few examples of reasons why equipment should be lowered into or pulled from a well.

To provide a support for such equipment, a side pocket mandrel 52 may be placed in or hung from one or more sections of the production tubing or pipe line 51. As here shown, pipe section 51a is connected above the side pocket, and pipe section 51b is connected below the side pocket. The side pocket 52 is shaped and dimensioned to receive a module 53 which may be lowered through the line 51, at the end of a wire 54. If electrical or other connections are required, they may be placed in a bayonet type connector 55 on the lower end of the module 53. A mating connector 56 may be placed in the bottom of the side pocket 52. Therefore, when the module 53 is dropped into the side pocket 52, the connector 55 slides into the connector 56.

The problems illustrated by the equipment in FIG. 1 should be apparent, after a moment's reflection. First, the module must have some means for detecting when it has been lowered to a depth which is opposite an opening 60 for receiving the lower end of the module 53. Then, upon such detection, the lower end of the module must be deflected in direction A so that it will enter the opening 60 and move into the side pocket mandrel 52.

The wireline tool must include a connector mechanism 61 by means of which it is able to attach itself to and detach itself from the module. Thus, the wireline tool may be lowered to grip the module in the side pocket and then it may be pulled up the pipe line, after the module 53 has been dislodged from the side pocket 52. The lower end of the wireline tool must also deflect itself through the opening 60, so that the connector 61 will have an opportunity to latch itself onto the module.

The remainder of the figures show details of the inventive wireline running tool, which solves all of these and other problems.

Figure 2:
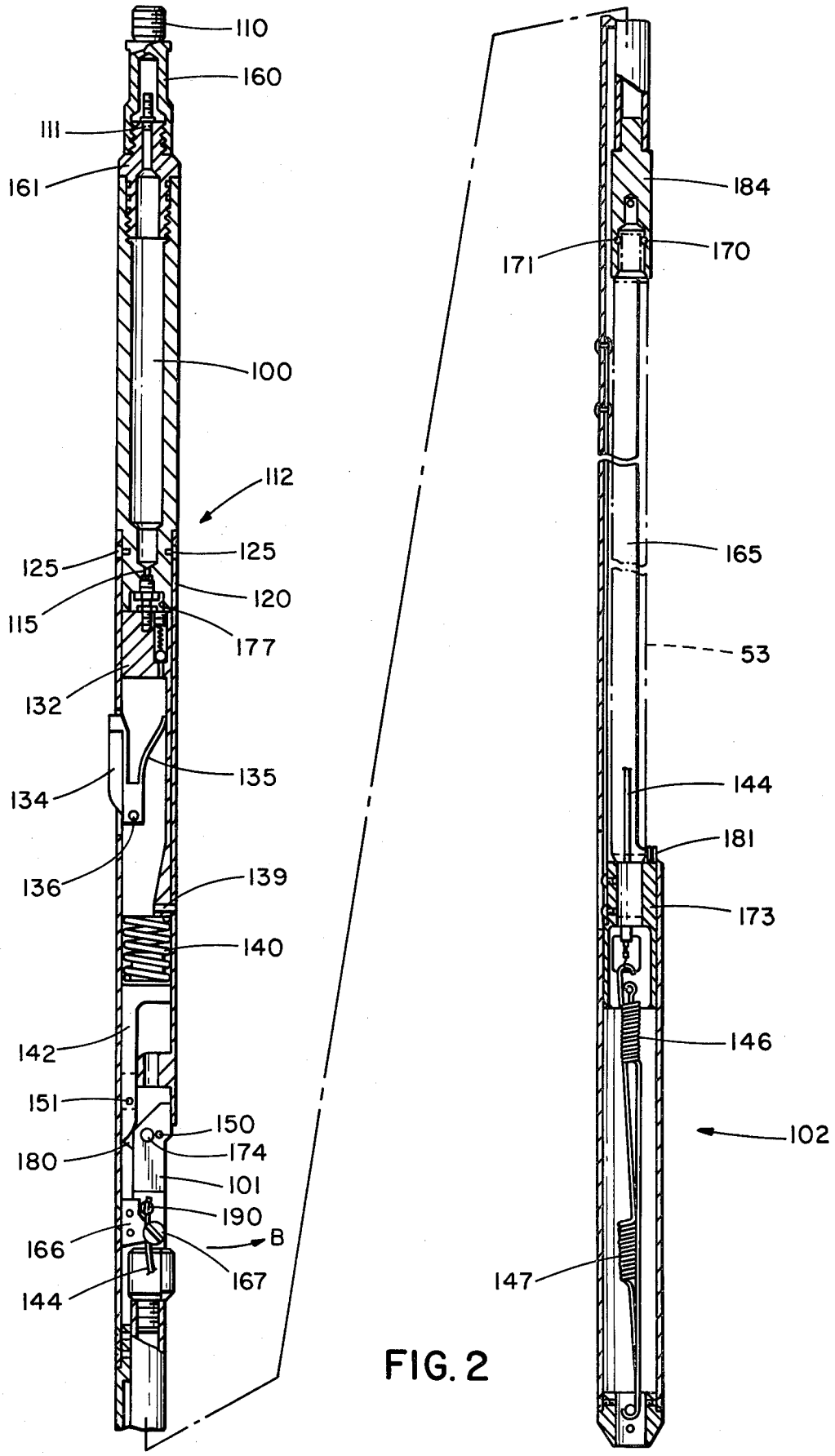
FIG. 2 is a cross-sectional view of a wireline running tool for lowering the module into the well.

The principal parts of the structure shown in FIG. 2 are a gas pressure chamber assembly 100, a kickover arm assembly 101, and a module holding cable and spring tension assembly 102. The pressure chamber 100 stores a gas under pressure, which provides the downhole pneumatic power source for operating the wire running tool. The position of the kickover arm 101 is controlled by shear pins which sequentially break to deflect the wire running tool into the side pocket 52 and to enable the wireline tool to be pulled from the well. The cable and spring tension assembly 102 includes latches for gripping and releasing the module.

Figure 3:
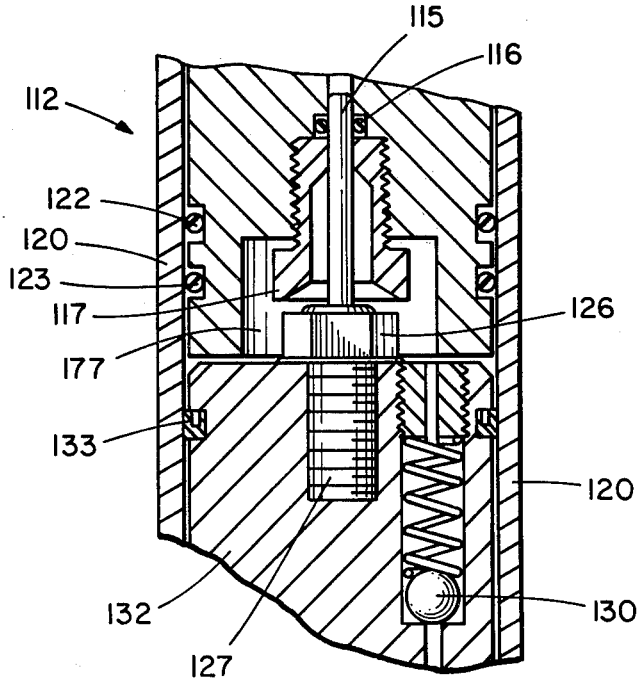
FIG. 3 is an enlarged view of a pneumatic control system for use in the well.

The entire pressure chamber assembly comprises a threaded connector end 110, a Schrader valve 111, and the gas pressure chamber 100. The assembly may be attached to the wireline by means of a threaded cap fitted over the end 110. The opposite end 112 of the gas pressure chamber 100 is shown in enlarged scale in FIG. 3. A stopper valve 115 is sealed in an orifice in the chamber wall by means of an O-ring 116 held in place by an O-ring keeper 117. When this stopper is pulled from the chamber 100, there is a release of pneumatic pressure which triggers the kickover into the side pocket. An outside wireline tool housing 120 is sealed against the outside wall of the gas pressure chamber 100 by two O-rings 122, 123 and held in place by any suitable number of screws 125 (FIG. 2). The stopper 115 is integral on and held in place by a hex head nut 126 turned onto a threaded shaft 127 fitted into the drive piston 132. A ball check valve 130 seats against an imperfect seat in order to provide for bleeding the pressure chamber. The ball check valve 130 bleeds to fill the small volume cavity 177 between the drive piston 132 and the lower extremity of pressure chamber 100 during run-in. Thus, the piston has equal pressures on both sides, before the pin 115 is extracted, so that piston motion is not biased by ambient pressure. This ball check valve enables a slow release of pneumatic pressure so that the drive piston may be released in case the module becomes stuck in the pipe 51.

The member 132 is a drive piston which is sealed against the inside of the housing 120 by a sealing piston ring 133. This drive piston is pressured downwardly (as viewed in FIG. 2) in order to cause the kickover of the module.

Next to the pneumatic pressure assembly and controlling the drive piston is a guide means or a mule shoe index member 134 which is pivoted on pin 136 and held in an extended position (as shown in FIG. 2) by means of a leaf spring 135. FIG. 1 shows a portion 138 of the pipe line which is called a mule shoe, that contains a slot 137. The various shapes are such that, when the tool is pulled upwardly in the tubing, the spring biased index member 134 slips into this mule shoe slot for radial orientation of the wireline tool. As the tool moves upwardly, the index member 134 snags into the top of slot 137 for a period which is long enough to break the shear pin 139 locking drive piston 132 to housing 120. The tool is thus aligned with the kickover arm 101 aimed at the side pocket. When the shear pin 139 breaks, the pin valve 115 is pulled by the upward motion of the entire tool, except for the piston, which is now caught in the slot. Thus, as will become more apparent, the deflection of the module into the side pocket occurs when the mule shoe index member is forced out of position to shear a pin 139. A compression spring 140 acts as a shock absorber when the pneumatic pressure drives the kickover arm 101 via pistons 132, 142.

Attached to the kickover arm 101 are a pair of tension cables 143, 144, which are biased by springs 146. These cables are pulled when the kickover arm pivots, in order to eject the lower end at the module by forcing the leaf spring 182 into a bowed shape, as best seen in FIG. 5.

Beyond the kickover arm assembly 101 is a module support housing which is controlled by the tension cables 143, 144. The module 53 itself fits between a spring loaded piston 173 and a tool neck 184. When the cables are relaxed with the kickover arm 101 in its retracted position, these two sockets approach each other to grip the module. When the kickover arm is extended, the cables are pulled or extended so that piston 173 moves upwardly, as viewed in FIG. 5. This forces the lower end of the module 53 toward the side pocket, by bending the leaf spring 182 out of the axis of the tool, so that it may swing into the side pocket.

Figure 4:
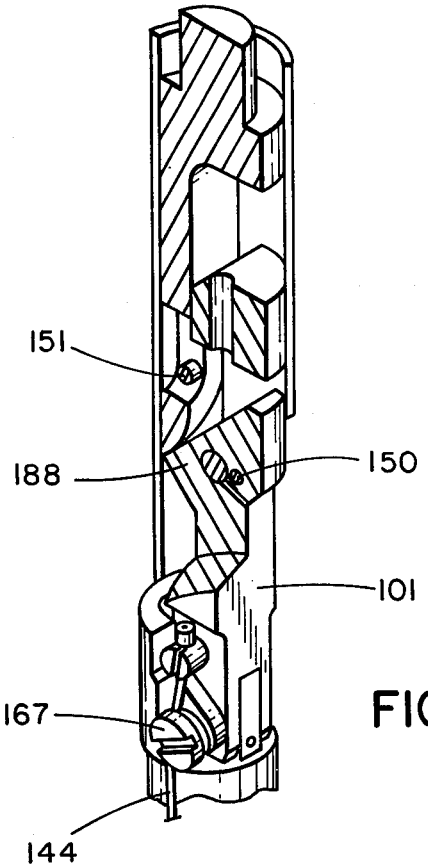
FIG. 4 is a perspective view, in cross section, which shows the position of a kickout arm while a module is being lowered into the well.
Figure 5:
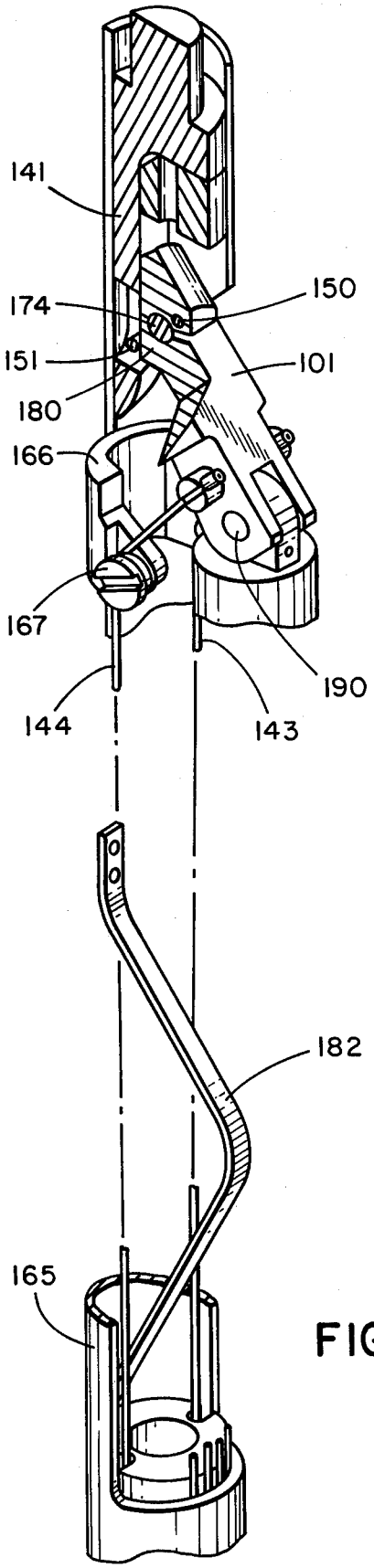
FIG. 5 is a view similar to FIG. 4, which shows the position of the kickout arm while the module is being diverted into the side pocket mandrel.
Figure 6:
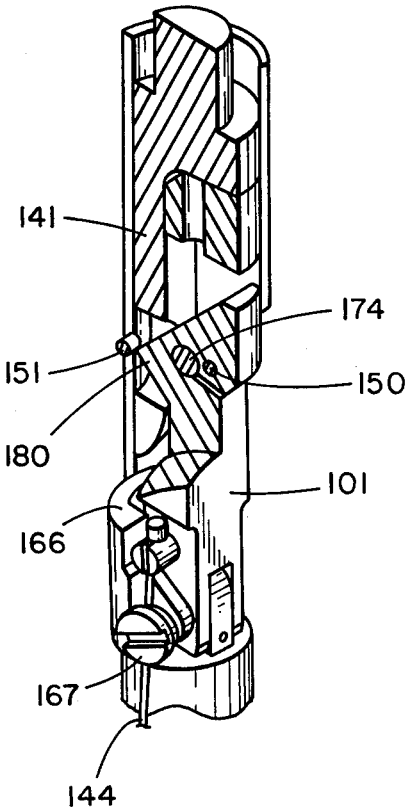
FIG. 6 is a view similar to that of FIGS. 4 and 5, which shows the position of the kickout arm while the wireline tool is being pulled out of the well.

The operation of the wire running tool is controlled by the manipulation of the kickover arm 101 between three distinct positions, which are individually shown in FIGS. 4–6. In FIG. 4, the kickover arm 101 is shown in the position which it assumes during running in (i.e., while the module 53 is being dropped down the production tubing or pipe line 51). During this phase of its operation and before the kickover arm 101 extends, it is held in place (FIG. 4) by two shear pins. When the kickover arm operates (FIG. 5), the shear pin 150 is sheared or broken, while the pin 151 remains intact. In FIG. 5, the kickover arm is shown in the position where the module 53 is being deflected into the side pocket. In FIG. 6, the kickover arm is shown in the position where the wire running tool is being pulled up the production tubing or pipe line 51 after the module has been dropped into the side pocket. When the tool is pulled up the pipe line 51, the second pin 151 is sheared (FIG. 6) to enable the kickover arm to return to its retracted position. Also, the cables 143, 144 relax and allow the spring 146 to pull the piston 173 back down to return the leaf spring 182 to its original position.

It is thought that further details of the tool will be understood best from a description of how it operates.

Before the wireline tool is used to run into the tubing, the pressure chamber assembly, at the top of the tool, must be dismantled. From the top of the tool, the cap 160 is removed to expose the Schrader tank valve 111. The nib of the Schrader valve is depressed to be certain that no pressurized gas is in the pressure cylinder 100, below the Schrader valve. Next, an adapter 161 is unscrewed so that the Schrader valve and the pressure cylinder 100 may be inspected to be certain that no oil or water is inside. Then the screws 125 are removed to detach the pressure cylinder 100 from the wireline tool housing 120.

The drive piston 132 is slipped out of the housing 120 so that all pin holes may be inspected to be sure that they are clear. The spring 140 slips out of the wireline tool housing 120 to enable the kickover piston 142 to drop out. Then, all of the sheer pins 136, 139, 150, 151 are replaced.

The tool reassembly begins at the top. The adapter 161 is screwed into the pressure cylinder 100. The drive piston 132 is put into place so that the stopper 115 is well into the pressure cylinder. The kickover arm 101 is slid into the tool housing 120 with the compression spring 140 between the top drive piston 132 and the kickover piston 142. Both the drive piston 132 and the pressure cylinder 100 are slid into place so that all slots are in alignment. The mule shoe index member 134 must be depressed against its spring 135 to enable the kickover piston 142 to travel into the housing 120. Once the pressure cylinder is shouldered at its final position, the screws 125 are installed and tightened to secure the pressure cylinder in the housing. At this time, the mule shoe index member 134 is free to spring out of the housing.

The shear pin 139 is placed through the housing 120 and drive piston 132 to pin the drive piston 132 in place. When this pin 139 is sheared by upward motion of the tool, the drive piston 132 may be moved downwardly to fire the pneumatic mechanism.

A screwdriver or other similar tool is used to push the kickover piston 142 against the compression spring 140. The kickover arm 101 may then be lowered into coaxial alignment within the housing.

A module housing 165 is attached to the tool assembly in order to carry the module 53 downhole into the production tubing 51. This run-in housing 165 may be secured to the lower end of the wireline tool housing 120 by means of pins and flat head screws. A thread sealer is applied to the screws to prevent any jarring action from loosening them and thereby causing the tool to malfunction. A tension cable support and guide bracket 166 is positioned between an adapter and the kickover arm 101. A pair of Fairlead pins (one is seen at 167) are slipped into holes in the bracket 166. The ends of tension cables 143, 144 may be placed into the slots under the head of the pin. Then the tension cables 143, 144 are ready to be pulled when the kickover arm 101 is extended. The kickover arm will have to be slightly levered out to allow installation of these wires.

A tool neck 184 of the run-in tool is attached to the top of the module 53 by means of two tangential shear pins 170, 171. When this assembly is ready to be connected to the wireline tool, the last operation is to work the two tension cables 143, 144 so that a spring loaded piston 173 may be moved down in the housing 165. The module is fitted into the housing 165 with the connector end 55 fitting into an opening in the top of the spring piston 173, at the bottom of the housing 165.

The pivot pin 174 is aligned to connect the run-in tool to the kickover arm 101, with the kickover arm extended about 25°. The kickover arm is then forced down and into alignment against the force of spring 140. Finally, a shear pin 150 is installed near the pivot at the base of the kickover arm 101, to secure it in place. This completes the assembly of the running tool, and it is ready for the pneumatic charging.

The charging hose of any suitable nitrogen supply is connected to charge the pressure cylinder 100, via the Schrader fitting 111, to a pressure of about 800 lbs. per square inch, in one exemplary device. When the wireline tool is to be run below the surface of water or oil, as in a deep well, for example, an additional pneumatic pressure must be supplied in the pressure cylinder 100 to offset the anticipated hydrostatic head pressure in the well bore. In the exemplary device, this pressure requirement follows a formula of about 0.5 lbs. per square inch per foot of operating depth under the surface of water, and about 0.4 lbs. per square inch per foot of operating depth under the surface of oil. These considerations also depend on the density of the fluid. For example, at a depth of about 2,000 feet under water about 1,000 psi is required to offset the hydrostatic head, and about 800 lbs. is required to operate the tool. Hence, this combination results in a charging pressure of 1,800 psi, in order to run the tool at a depth of 2,000 feet.

Once the desired pressure is read on a regulator gage at a nitrogen bottle, the Schrader valve 111 is closed. A solid metal cap 160 is placed over the pressure fitting in the wireline tool assembly.

A void space 177 (FIG. 3) is provided between the pressure cylinder 100 and the drive piston 132. This void fills with the atmosphere and equalizes the ambient pressure across the seal 133. The check valve 130 helps equalize the "head" pressure so that it does not prevent the operation of the drive piston when the mule shoe index member 134 initiates the kickover sequence. This check valve 130 also leaks slightly after the tool is "fired". If the tool should fire accidentally while it is in the production tubing or pipe 51, it will stick, since the kickover arm 101 wedges against the pipe or tubing.

Bleed-down into the chamber 177 occurs when the mechanism misfires in the wrong place, as in the tubing, because the seal at the check valve 130 is imperfect. The imperfect seating between the ball check 130 and the seating surface guarantees that minute passages exist both ways. This principle could also be accomplished by an additional check valve, reversed direction, with a small orifice to limit the bleed rate. Thus, the unit becomes unstuck when the pressure bleeds from the pressure chamber 100 through the cavity 177 and out via the check valve 130.

Means are provided for causing a kickover sequence when the run-in tool reaches the mule shoe. In greater detail, the charge of high pressure gas is held in the pressure cylinder 100 to be available to drive the mechanism with the required force. (FIG. 4 shows the position of the kickover arm while the module is being lowered. No pins are sheared at this time.) The kickover drive sequence is initiated when the mule shoe index member 134 strikes the top of a slot while travelling up the tube, the slot being at the apex of the mule shoe in the production line tubing. Responsive thereto, the mule shoe index member 134 is pulled out, to pivot on and break the shear pin 139. This pulls the drive piston 132 about ½ inch to ¾ inch, to thereby extract the small diameter pin or stopper 115 from a port in the pressure cylinder 100. This first motion of the mule shoe index member 134 does not immediately result in any motion of the kickover arm 101. The shear pin 139 breaks responsive to movement of the piston 132.

When the pin or stopper 115 is extracted from the pressure cylinder 100, a resulting blast of high pressure gas forces the drive piston 132 against the kickover piston 142. Thereafter, these two pistons 132, 142 move as one piston to drive against a tang 180 of the kickover arm 101, which pivots on the pin 174 and swings out in direction B. The shear pin 151 does not break at this time, but the shear pin 150 does break when the arm moves. The pivot pin 174 is never broken. (FIG. 5 shows the position of the kickover arm 101 after the pin 150 shears and the module swings toward the side pocket.)

As the kickover arm 101 swings out in the direction B, it lifts the module 53 out of the housing 165, so that the bottom of the module clears the keeper 181 at the bottom of the run-in housing. The kickover arm 101 offsets the module 53 about 2 inches, from the center line of the wireline running tool. Responsive thereto, the lower end of the module is swung through the opening 60 and into the side pocket mandrel 52. Then, the module can be lowered into the pocket in the mandrel with an impact of sufficient force to drive the connectors 55, 56 together.

More specifically, the two small control tension cables 143, 144 are pulled by the kickover arm 101 during its swing. These two cables lift the piston 173 at the bottom of the run-in housing in order to deflect a long leaf spring 182 (FIG. 5). This leaf spring forces the lower end of the module 53 outwardly from the tubing or pipe, toward the side pocket, with the connector end 55 in a position over the top of the side pocket mandrel 52. As the module is lowered further, the lower end of the wire running tool is forced into the continuation of the tubing or pipe **51*b*, below the side pocket mandrel 52**.

The entire wireline running tool enters the section of the pipe **51*b* which is below the side pocket mandrel 52. The module swings into the side pocket, is set, and latches engage. As the module is dropped into its final location, springs on the module expand into the side pocket cavity so that the module is locked in place. Further, the jarring shock of the module dropping in place shears the two tangential shear pins 170, 171 which attach the module 53 to the run-in tool neck 184**. Once these two pins are sheared, the wireline running tool can be lifted clear, while the module remains in place.

The wireline running tool is lifted upwardly until the swinging kickover arm 101 engages a baffle or cam surface at the top of the side pocket mandrel 52. Further upward motion breaks the shear pin 151, which has been adjacent the tang 180 of the kickover arm 101. The breaking of the shear pin 151 allows the kickover arm to swing back into the wireline running tool (FIG. 6).

The entire wireline running tool can then be lifted out of the pipe or production tubing 51 while the kickover arm 101 remains inside the tool housing.

Figure 7:
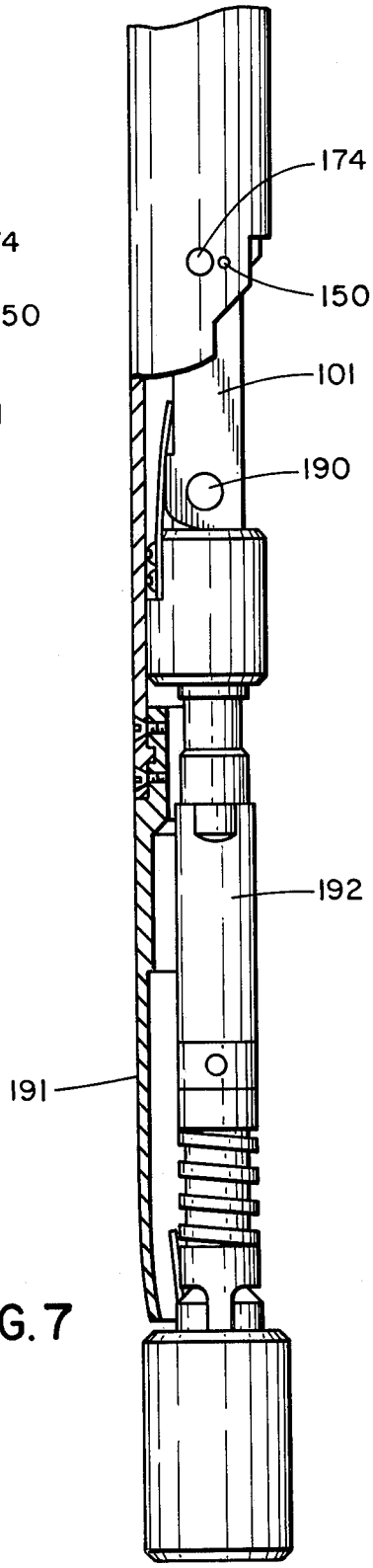
FIG. 7 shows, partly in cross section, a tool which is used to pull the equipment out of the production tubing or pipe line.

Recovery or extraction is essentially the reverse operation, when it is necessary or desirable to retrieve the module 53 from the side pocket. The pulling tool (FIG. 7) is substituted for the lower end of the wireline running tool of FIG. 2. The substitution is made at the pivot pin 190 of the kickover arm 101. The pulling tool is enclosed within an outer housing 191.

The wireline running tool operates as before, except that this time it drives a pulling tool 192 out of the housing 191 and into the guide leading into the side pocket. As the tool 192 is lowered into the side pocket, it fits onto a fishing neck at the top of the module 53. Once the fishing neck is so engaged, an upward movement on the wire breaks small pins to enable the module to slide upwardly and release its spring catches, which had been securing it in the side pocket. Further lifting brings the kickover arm 101 into position, where the pin 151, beneath the tang 180, is sheared. The kickover arm 101 swings back into line and the module is now suspended below the pulling tool so that the entire unit may be extracted from the pipe 51a.

Those who are skilled in the art will readily perceive how various modifications may be made. Therefore, the appended claims are intended to cover all equivalent structures falling within the true scope and spirit of the invention.

We claim:

1. A wireline running tool comprising a pressurized pneumatic power source, a kickover means, and a module holding assembly, guide means on said tool for detecting an index mechanism adjacent said tool, means responsive to said guide means for releasing the pressurized gas of said power source to operate said kickover means, and means responsive to operation of said kickover means for deflecting said module into a holding position.

2. The tool of claim 1 and spring means for deflecting the lower end of said module toward said holding position.

3. A wireline running tool comprising a power source, said power being a pressurized pneumatic chamber having an orifice therein sealed by a stopper means, a kickover means, and a module holding assembly, guide means on said tool for detecting an index mechanism adjacent said tool, means responsive to said guide means for releasing said power source to operate said kickover means, and means responsive to operation of said kickover means for deflecting said module into a holding position.

4. The tool of claim 3 wherein said guide means comprises means for pulling said stopper means from said orifice, thereby releasing the pressurized gas in said pneumatic chamber, whereby a jet reaction occurs, and means responsive to said jet reaction for operating said kickover means.

5. The tool of claim 4 and a plurality of shear pins located throughout said tool, means for causing said pins to break in sequence, thereby establishing the sequence of tool operations.

6. The tool of claim 1 and a plurality of shear pins located throughout said tool, means for causing said pins to break in sequence, thereby establishing the sequence of tool operations.

7. The tool of claim 6 and means responsive to operation of said guide means for breaking a first of said shear pins, and means responsive to the breaking of said first pin for releasing said power source.

8. A wireline running tool comprising a power source, said power source being a pressurized pneumatic cylinder, a kickover means, a module holding assembly, guide means on said tool for detecting an index mechanism adjacent said tool, a plurality of shear pins located throughout said tool, means for causing said pins to break in sequence, thereby establishing the sequence of tool operations, means responsive to operation of said guide means for breaking a first of said shear pins, said first shear pin causing a jet reaction responsive to release of pressurized gas from said pneumatic cylinder, the release of said gas operating said kickover means, and means responsive to operation of said kickover means for deflecting said module into a holding position.

9. The tool of claim 8 and check valve means for slowly leaking gas from said pressurized cylinder, and means responsive to exhaustion of said cylinder for releasing mechanisms which might cause said tool to bind in a chamber during defective operations.

10. The tool of claim 8 and means responsive to said jet reaction for breaking a second of said shear pins, means responsive to the breaking of said second shear pin for operating said kickover means.

11. The tool of claim 10 and means responsive to the landing of said module for breaking at least a third shear pin, and means responsive to the breaking of said third pin for releasing said module.

12. The tool of claim 11 and means responsive to a retrieval of said tool after said module is released for breaking a fourth shear pin, and means responsive to the breaking of said fourth pin for releasing said kickover means.

13. A wireline running tool for lowering a module into a side pocket of a production tubing of a gas, oil, or similar well, said production tubing comprising upper and lower pipe lines having a side pocket mandrel between them, with a mule shoe at the top end of said side pocket mandrel, said tool comprising means on said running tool for detecting said mule shoe, pneumatically powered means responsive to said mule shoe detecting means for deflecting said module into said side pocket mandrel, means responsive to said module landing in said side pocket for causing said tool to release said module, and means thereafter responsive to a raising of said tool to a position adjacent said mule shoe for collapsing said deflection means to a compact configuration wherein said tool may be pulled from said well.

14. A wireline running tool for lowering a module into a side pocket of a production tubing of a gas, oil, or similar well, said production tubing comprising upper and lower pipe lines having a side pocket mandrel between them, with a mule shoe at the top end of said side pocket mandrel, said tool comprising means on said running tool for detecting said mule shoe, pressurized pneumatic chamber means for powering the operation of said tool, means responsive to said mule shoe detecting means for utilizing the pressurized gas of said chamber for deflecting said module into said side pocket mandrel, means responsive to said module landing in said side pocket for causing said tool to release said module, and means thereafter responsive to a raising of said tool to a positive adjacent said mule shoe for collapsing said deflecting means to a compact configuration wherein said tool may be pulled from said well.

15. The tool of claim 14 and means for deflecting the bottom of said module toward said side pocket simultaneously with the deflection responsive to said mule shoe detection.

16. The tool of claim 14 and means for slowly exhausting said pressurized chamber to release said tool in case it operates prematurely, before reaching said side pocket mandrel.

17. The tool of claim 14 and means for use with said tool for gripping said module in order to pull it back up said production tubing.

18. The tool of claim 14 and a plurality of shear pins, means for selectively breaking said shear pins in sequence, thereby establishing the sequence of tool operations.

19. The process for controlling functions in a deep hole well pipe line, said process comprising the steps of:

a. lowering a tool comprising a pressurized pneumatic chamber and a working module down said pipe line;
b. detecting when said tool reaches a predetermined level in said deep hole;
c. sequentially breaking a plurality of shear pins in said tool responsive to power from said pressurized chamber and to level manipulation of said tool; and
d. means responsive to the sequential breaking of said pins for operating said tool through a sequence for releasing pressurized gas from said chamber for either placing said working module in a position outside said pipe line or for retrieving said module from said position outside said pipe line.

* * * * *

UNITED STATES PATENT OFFICE

CERTIFICATE OF CORRECTION

Patent No. 4,074,762 Dated February 21, 1978

Inventor(s) WILLIAM H. PARKER and LAWRENCE HART

It is certified that error appears in the above-identified patent and that said Letters Patent are hereby corrected as shown below:

Column 7, line 67, "2 inches" should be --2-3/8 inches--.

Column 10, line 17, claim 13 - "deflection" should be --deflecting--.

Column 10, line 34, claim 14 - "positive" should be --position--.

Signed and Sealed this

Ninth Day of May 1978

[SEAL]

Attest:

RUTH C. MASON
Attesting Officer

LUTRELLE F. PARKER
Acting Commissioner of Patents and Trademarks